US009046237B2

(12) United States Patent
Stefanov et al.

(10) Patent No.: US 9,046,237 B2
(45) Date of Patent: Jun. 2, 2015

(54) LIGHT MODULE FOR A MOTOR VEHICLE HEADLAMP, CONFIGURED TO GENERATE A STRIPE-SHAPED LIGHT DISTRIBUTION

(71) Applicant: AUTOMOTIVE LIGHTING REUTLINGEN GMBH, Reutlingen (DE)

(72) Inventors: Emil P. Stefanov, Reutlingen (DE); Christian Buchberger, Reutlingen (DE); Henning Vogt, Stuttgart (DE)

(73) Assignee: AUTOMOTIVE LIGHTING REUTLINGEN GMBH, Reutlingen (DE)

( * ) Notice: Subject to any disclaimer, the term of this patent is extended or adjusted under 35 U.S.C. 154(b) by 0 days.

(21) Appl. No.: 14/150,151

(22) Filed: Jan. 8, 2014

(65) Prior Publication Data

US 2014/0198513 A1 Jul. 17, 2014

(30) Foreign Application Priority Data

Jan. 15, 2013 (DE) ..... 10 2013 200 442

(51) Int. Cl.
*F21S 8/10* (2006.01)

(52) U.S. Cl.
CPC ..... *F21S 48/17* (2013.01); *F21S 48/1154* (2013.01); *F21S 48/1241* (2013.01)

(58) Field of Classification Search
CPC ..... F21S 48/17; F21S 48/1705; F21S 48/171; F21S 48/1154; F21S 48/1241; F21S 48/1329; F21S 8/10
USPC ..... 362/507, 511
See application file for complete search history.

(56) References Cited

U.S. PATENT DOCUMENTS 5,772,306 A * 6/1998 Okuchi ..... 361/507
2012/0275173 A1* 11/2012 Hamm et al. ..... 362/487

FOREIGN PATENT DOCUMENTS

DE 10 2009 053 581 B3 3/2011

* cited by examiner

*Primary Examiner* — Andrew Coughlin
(74) *Attorney, Agent, or Firm* — Howard & Howard Attorneys PLLC

(57) ABSTRACT

A light module for a motor vehicle headlamp having an optical fiber configuration with at least one first optical fiber branch and one second optical fiber branch. Each of the two branches has a light exit surface each bordered by two narrow sides and disposed such that a narrow side of the first branch is disposed parallel and directly adjacent to a narrow side of the light exit surface of the second branch. Each branch exhibits two transport surfaces. The transport surfaces exhibit surface norms having a directional component, which faces more toward a first narrow side of the two narrow sides of the branch than toward a second narrow side of the two narrow sides of the branch, wherein the narrow sides lying directly adjacent and parallel to one another are a second narrow side of the first branch and a first narrow side of the second branch.

10 Claims, 6 Drawing Sheets

LIGHT MODULE FOR A MOTOR VEHICLE HEADLAMP, CONFIGURED TO GENERATE A STRIPE-SHAPED LIGHT DISTRIBUTION

REFERENCE TO RELATED APPLICATION

This application is based upon and claims priority to German Patent Application 10 2013 200 442.7 filed on Jan. 15, 2013.

BACKGROUND OF INVENTION

1. Field of Invention

The invention relates to a light module for a motor vehicle headlamp.

2. Description of Related Art

A light module as depicted in published German Patent DE 10 2009 053 581 B3 is known in the art which exhibits an optical fiber configuration having at least one first optical fiber branch and a second optical fiber branch. Each of the two branches exhibit a light entry surface and a light exit surface, wherein in each case the light exit surface is bordered by two narrow sides and two long sides. The two branches are disposed such that a narrow side of the first branch is disposed parallel and directly adjacent to a narrow side of the light exit surface of the second branch. The narrow sides of the light exit surfaces of the two branches are of the same length, while the long sides of the light exit surface of the second branch are longer than the long sides of the light exit surface of the second branch. Each branch has two transport surfaces, which border an optical fiber volume extending between the light entry surface and the light exit surface of each branch, on which light propagated in the optical fiber experiences a total internal reflection, and which are bordered by the long sides of the light exit surface of the branch.

The branches, together with numerous other branches, are a component of a primary lens. Each light entry surface has an LED, the light of which is coupled in the branch, and decoupled by the light exit surface. The light exit surfaces are disposed in a matrix, such that the sum of the light exit surfaces forms a surface emitting light in the manner of combined pixels, the shape of which can be varied by switching LEDs on and off. The light emitting surface is located in the interior of the headlamp, in the form of an inner light distribution, at a spacing of a focal length of a secondary lens thereof, and is projected therefrom in the form of an external light distribution in the region in front of the headlamp. This known light module will also be referred to as a matrix light module.

When the light module is used in a motor vehicle headlamp, the external light distribution on the driving surface occurs as an image of the inner light distribution, present in the interior of the headlamp in the form of combined pixels, which is formed on the light exit surface of the primary lens. By switching individual LEDs on and off (and thus, individual pixels), the images of the pixels in the external light distribution also appear as either light or dark. The switching off or dimming of individual LEDs (or groups of LEDs) thus enables, for example, a targeted limiting of the illumination in regions in which oncoming traffic could be blinded.

As known in the art, light modules may also generate light distributions having stripe-shaped individual light distributions lying adjacent to one another. Each stripe is generated by one optical fiber branch and one light source. In comparison with the matrix light module, each optical fiber branch replaces a column of optical fiber branches of the matrix in this case. The intended horizontal angular resolution of a light module of this type (which generates stripe-shaped light distributions) lies, for example, between 1.0° and 1.5° in the horizontal plane, wherein this directional condition is related to the designated use of the headlamp in a motor vehicle. This limitation is obtained in connection with the light sources normally available for use in motor vehicle headlamps, which have fixed dimensions in terms of their geometry and emit only limited luminous flux. This requirement further limits the variability of the lens system.

The high-power LEDs that are preferred and known in the art have a rectangular luminous (and thus active) light emitting surface, and a size of approximately 0.5 mm2. The active surface is constant, independent of the luminous flux delivered. The LED emission pattern (for example, the angular distribution of the emitted light) is likewise constant. Normally, this concerns a so-called Lambert characteristic. The so-called warm luminous flux in continuous operation of LEDs is, for example, approximately 80 lumen at a maximum acceptable electrical operating current. It is to be expected, however, that the warm luminous flux may increase to a certain degree over time. However, with respect to the present invention, the available luminous flux should be regarded as being limited.

For financial reasons, and due to reliability concerns, it is generally intended that the number of light sources in a light module be kept as low as possible. Light modules that generate stripe-shaped light distributions (in the following, also referred to as striped-light modules), are therefore preferred over light modules that generate light distributions created in a matrix. In order to project a sufficient luminous flux onto the driving surface, using a striped-light module (and thus, the fewest possible LEDs) in order to thus generate light distributions having predefined high maximal values for the luminosity and a predefined change to the luminosity along a vertical angular scale, a high degree of efficiency regarding light transference is also necessary. For this, the degree of efficiency regarding light transference is understood to mean, for example, the luminous flux exiting a secondary lens after its standardization to the luminous flux entering the primary lens.

Thus, the objective of the present invention is to provide a light module which enables a generation of vertical, stripe-shaped light distributions with a small number of light sources. The stripe-shaped light distribution should exhibit a first narrow side having a pronounced maximum luminosity. Starting from there, and running to the opposite second narrow side of the stripe-shaped light distribution, the luminosity should diminish. The maximum gradient of the illumination or luminosity facing the first narrow side of the light distribution should be much steeper than the maximum gradient facing the second narrow side. As a result, it should be possible to create an illuminated stripe having a sharply focused light/dark border at the first narrow side, an adjoining region of maximum luminosity, and a softly focused and continuously diminishing luminosity, thus a luminosity diminishing continuously over the length of the stripe as the distance to the sharply focused light/dark border and the luminosity maximum increases. The luminosity should decrease disproportionately in relation to the increase in distance as the distance to the maximum increases, and accordingly, in the opposite direction, the luminosity should increase disproportionately starting from the second narrow side toward the maximum luminosity, in relation to the distance from the second narrow side.

SUMMARY OF THE INVENTION

The present invention differs from the known matrix light module in that the specified transport surfaces of each branch exhibit surface norms which have a directional component and which face more toward a first of the two narrow sides of the branch than to a second of the two narrow sides of the branch. This applies to majority of all of the points on the transport surface onto which light coupled via the associated light entry surface falls. It is also important that the narrow sides lying directly adjacent and parallel to one another are a second narrow side of the first branch and a first narrow side of the second branch.

With total internal reflection, a beam falling on a point, perpendicular to the reflection surface at this point, or the surface norm at this point, respectively, and the beam reflected at this point lie in one and the same plane. Thus, with a given angle of incidence, one can control the direction of the reflected beam by the tilt of the reflecting surface and thus by the orientation of the surface norm.

Because the surface norms of the respective two transport surfaces of each branch (which are bordered by the long sides of the light exit surface of the branch) exhibit a directional component which faces more toward a first of the two narrow sides of the branch than toward a second of the two narrow sides of the branch, the light tends to be deflected toward the first narrow side in the course of the reflection. Because this applies for a majority of the points on the transport surface, a greater intensity is obtained in the half of the light exit surface that borders the first narrow side than in the half that is bordered by the second narrow side. Further, because one narrow side of the first branch is disposed such that it is parallel and directly adjacent to a narrow side of the light exit surface of the second branch, the images of the light exit surfaces in the external light distribution are disposed such that they border one another.

Further still, because the narrow sides lying parallel and directly adjacent to one another are a second narrow side of the first branch and a first narrow side of the second branch, a configuration is obtained in which a darker region of the light exit surface of the first branch borders a brighter region of the light exit surface of the second branch. As a result, the regions bordering one another are preferably equally bright at the border. Thus, a luminosity maximum of the one surface thus meets a luminosity minimum of the other surface, wherein the maximum of the one surface has the same value as the minimum of the other surface.

Still further, because the narrow sides of the light exit surface of the two branches are of the same length, while the long sides of the light exit surface of the second branch are longer than the long sides of the light exit surface of the second branch, the light exit surface of the second branch is larger than the light exit surface of the first branch. Accordingly, the luminous flux coupled in the first branch is distributed over a smaller light exit surface than the luminous flux coupled in the second branch. Thus, if the same light sources are used in each case, a greater maximum luminosity can be generated with the smaller light exit surface of the first branch than with the larger light exit surface of the second branch.

Thus, the configuration having the two optical fiber branches delivers a stripe-shaped light distribution which is bordered in the longitudinal direction of the stripe by the first narrow side of the light exit surface of the first branch and the second narrow side of the light exit surface of the second branch. Because of this, the luminosity decreases from a pronounced maximum, which lies at the first narrow side, and runs to the opposite, second narrow side. The gradient of the illumination at the maximum facing the first narrow side is much steeper than at the maximum facing the second narrow side. As a result, an illuminated stripe is created that has a light/dark border at the first narrow side and a softly focused and continuously diminishing luminosity at the other maximum. The luminosity decreases disproportionately in relation to the increasing distance, as the distance to the maximum increases. Accordingly, in the opposite direction, it increases disproportionately in relation to the distance from the second narrow side, starting from the second narrow side toward the maximum.

With an adjacent configuration of the optical fiber configurations having a first optical fiber branch and a second optical fiber branch in a light module, the present invention enables the generation of a light distribution composed of individual stripes, which exhibits a pronounced intensity maximum at one narrow side of the stripe, and continuously diminishing intensity (and thus, a continuous decrease in the luminosity) of the stripe as the other narrow side is approached.

These advantages are obtained with a number of light sources which is, in particular, smaller than the number of light sources that are needed for a matrix light module intended to generate a comparable light distribution in terms of the maximum luminosity and the diffusion luminosity. In one embodiment, the invention enables the generation of stripe-shaped light distributions subject to the previously mentioned boundary conditions, having a pronounced light/dark border with a luminosity maximum of more than 120 lux and a luminosity diffusion extending to a vertical angular width of up to 6°.

Another advantage of the light exit surface (which extends vertically) is that the secondary lens, which is downstream of the primary lens in the propagation direction of the light, can be smaller in this vertical axis than would be case without the vertical extension of the light exit surface of the primary lens. This is obtained by the Etandue conservation principle. In one embodiment, as a result of the improved vertical light bundling by the primary lens, the vertical height of a secondary lens can be reduced to 40 mm (values of 60-80 mm are known in the art).

The focusing lens forming the light distribution (having optimized optical fiber branches in accordance with the present invention) has a high degree of light transference efficiency. As such, it is possible to obtain values of 50% to over 60% for a system including a primary lens and a secondary lens (for example, without a cover plate). This means that 50% to over 60% of the light energy coupled in the primary lens also exits the secondary lens. The value depends on the aspect ratios of light exit surface (the ratio of the lengths of the narrow sides to the lengths of the long sides) and the position of the optical fiber with regard to the optical axis of the secondary lens. Advantageously, because of the high degree of efficiency of the light transference in the branches/the primary lens, fewer LEDs are required to obtain light distributions conforming to the regulations. For the implementation of a low beam light function and a high beam light function, 80-120 LEDs, each emitting 80 lumen of luminous flux are necessary for a matrix light module known from published German patent DE 10 2009 053 581 B2. The present invention makes it possible to reduce this number to approximately 60 LEDs.

These advantages are closely related to a high efficiency for the optical fiber branches used in the scope of the invention. These high efficiencies are obtained because the primary lens (or, the individual optical fiber branches of the primary lens, respectively) concentrate the light propagated therein efficiently, in order to generate a bundle from a light distribution of an LED according to the Lambert principle, which is concentrated onto a comparatively small light entry surface of a secondary lens that is, for example in one embodiment, 40 mm tall.

The bundling necessary can only be obtained if the optical fibers are constructed according to the principle discussed above, and the narrow sides of the light exit surfaces of the branch have a horizontal width of approximately 1.9 mm-2.1 mm. Because the angular resolution is predefined, a preferred focus range for the secondary lens is obtained, which lies between 90 mm and 100 mm in one embodiment. It is not possible to obtain a resolution based on metal-plated reflectors functioning as the primary lens. A primary lens of this type cannot fulfill the established requirements because metal-plated reflectors absorb light (approximately 15%/reflection) and, with multiple reflections, quickly absorb a major portion of the luminous flux, and convert it to heat. This eventually leads to damage to the reflectors through overheating and prevents achievement of (or even coming close to) the desired luminosity value. Only highly transparent TIR-based (Total Internal Reflection) primary lenses are capable of bundling the LED luminous flux at the necessary degree of efficiency in the required angular range. Thus, when dealing with striped or matrix headlamps having an angular resolution, it is impossible to avoid using an optical fiber-based primary lens. As has already been explained, specific geometric dimensions of primary lens are then already limited by the size of the LEDs.

The present invention provides a solution, which has the potential of fulfilling previously unfulfilled boundary conditions, and addressing new challenges. Further advantages will be understood from the dependent claims, the description and the attached drawings. It is understood that the features specified above, and which are to be explained further in the following, can be used not only in the respective specified combinations, but also in other combinations, or individually, without abandoning the scope of the present invention.

BRIEF DESCRIPTION OF THE DRAWINGS

Shown are, in each case in a schematic form.

DETAILED DESCRIPTION OF THE PREFERRED EMBODIMENT(S)

Figure 1:
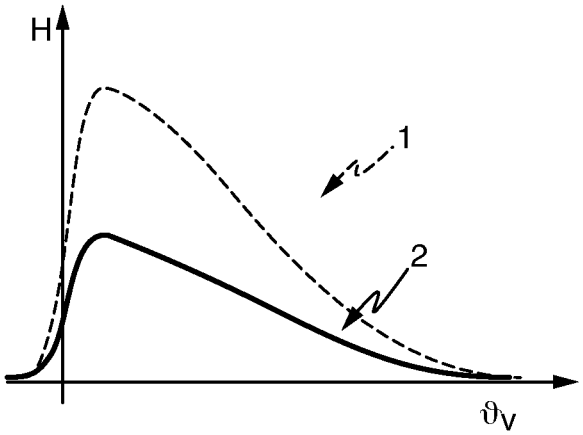
FIG. 1 shows a desired, and obtainable with one single LED, luminosity profile for a stripe-shaped light distribution.

Elements that are the same, as well as those corresponding functionally to one another, are indicated by the same reference symbols throughout the figures. The curve indicated by a broken line in FIG. 1 represents a desired luminosity profile 1 of a stripe-shaped light distribution over the angle ΘV, as it is occurs in the region in front of the light module on a measurement screen disposed perpendicular to the main emission direction of the light module. This angle indicates an angular deviation in the vertical plane of a motor vehicle longitudinal axis with the designated use of the light module in a motor vehicle headlamp in a motor vehicle, which is located at the level of the horizon in front of the vehicle. The value ΘV=0 thus corresponds to the level of the horizon. In one embodiment, the desired light distribution of profile 1 exhibits practically no luminosity below the horizon, followed by a steep increase to a large maximum value (which occurs slightly above the horizon) and a gradual decrease to the value of zero as the value of the angle above the horizon increases. The decrease occurs at a continuous (and, disproportionate) rate as the spacing to the horizon increases, as indicated in part by the curve of the profile bending toward the left. The curve indicated by a solid line represents a luminosity profile 2 that can be obtained with a single optical fiber branch, which will be explained in greater detail below, and is supplied by a single LED. This profile 2 exhibits a shape very similar to the desired profile 1, but remains at its absolute values below the values of the desired profile 1. This is because the luminous flux of the LED (which provides a single branch with light) is too low. The shape of the profile that can be obtained is also dependent on the geometry and size of the light exit surface of the semiconductor light source that is used, which is disposed in a light module of a motor vehicle headlamp directly in front of the light entry surface of the optical fiber branch. The obtainable curve is based on the use of a semiconductor light source (typically used for headlamps in motor vehicles) which delivers a specific luminous flux. The desired profile 1 would then be obtained from profile 2 without further change to the configuration if a light source of the same geometry, but having an accordingly higher luminous flux, could be used. A light source of this type, however, is not available.

Using two LEDs instead of one in order to provide an accordingly higher luminous flux, necessitates modification of the optical fibers, at least to the extent that their light entry surfaces allow for the coupling of light from two light sources. Thus, the light entry surface must be larger, in particular, than if it were to only allow for the coupling of light from a single light source. This necessitates a change in the geometry of the optical fiber (for example, the ratio of its unchanged light exit surface to the now larger light entry surface). This results in a profile 3. Thus, the same supplying luminous flux is required with the profile 1 as that required for profile 3. Further, the profile 3 exhibits a maximum that is lower and has a vertically wider expansion. As seen toward the right of FIGS. 1 & 2, the luminosity diffusion in the vertical axis decreases quickly, and a relatively large amount of light is distributed upward, and thus away from the light/dark border. Despite the doubled luminous flux (in relation to profile 2), profile 3 exhibits no doubling of the maximum value. Instead, an undesired widening of the maximum value occurs, and a profile, that has neither the shape nor the height of the desired profile 1.

In contrast, the desired profile 1 is obtained with the invention by using the available semiconductor light sources. A substantial element of the invention includes the described configuration of at least two optical fiber branches, each of which is supplied by a single semiconductor light source. Each of the at least two optical fiber branches illuminates only a portion of the vertical angular width of the desired light distribution thereby. Profile 1 corresponds to a stripe, such as that generated by two branches for each stripe in the scope of the present invention. The maximum for profile 1 is higher than the maximum of profile 3 generated with the same luminous flux by approximately one fourth. The diffusion of profile 1 is likewise more pronounced.

Figure 3:
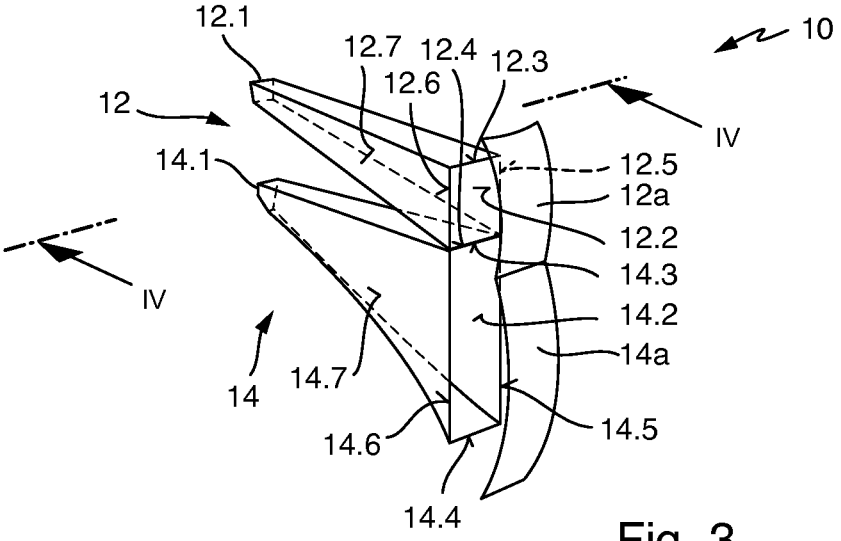
FIG. 3 shows an optical fiber configuration having at least one first optical fiber branch and a second optical fiber branch.

FIG. 3 shows an optical fiber configuration 10 having at least one first optical fiber branch 12 and a second optical fiber branch 14. The first branch 12 has a light entry surface 12.1 and a light exit surface 12.2. The light exit surface 12.2 is bordered by two narrow sides 12.3 and 12.4, as well as two long sides 12.5 and 12.6. The second branch 14 has a light entry surface 14.1 and a light exit surface 14.2. The light exit surface 14.2 is bordered by two narrow sides 14.3 and 14.4, as well as two long sides 14.5 and 14.6. The two branches 12, 14 are disposed such that a narrow side 12.4 of the first branch 12 is disposed parallel and directly adjacent to a narrow side 14.3 of the light exit surface 14.2 of the second branch 14. The narrow sides of the two branches are of equal length, while the long sides 14.5 and 14.6 of the light exit surface of the second branch are longer than the long sides 12.5 and 12.6 of the light exit surface of the second branch. Each branch has two transport surfaces, which border an optical fiber volume extending between the light entry surfaces and the light exit surfaces of each branch, and which, in turn, are bordered by long sides of the light exit surfaces, and on which light propagated in the optical fiber is subjected to a total internal reflection.

FIG. 3 shows a transport surface 12.7 of the first branch 12, which is bordered by the long side 12.6 of the light exit surface of the first branch. The other transport surface, bordered by the other long side 12.5, is concealed by the optical fiber branch 12. A transport surface is a border surface of an optical fiber on which total internal reflections occur. FIG. 3 also shows a transport surface 14.7 of the second branch 14, which is bordered by the long side 14.6 of the light exit surface of the second branch. The other transport surface, bordered by the other long side 14.5, is concealed by the optical fiber branch 14. These transport surfaces differ from other transport surfaces of the respective optical fiber in that they are bordered by the long sides of the light exit surface of the branch, wherein one transport surface is bordered in each case by a long side. Other transport surfaces of the two branches are bordered, in each case, by a narrow side of a respective branch.

The light exit surface 12.2 of the first branch is allocated to an exit lens surface 12.*a,* disposed downstream in the beam path. Analogously, the light exit surface 14.2 of the second branch 14 is allocated to an exit lens surface 14.*a*, disposed downstream in the beam path. These exit lens surfaces are, in each case, bowed away from the branches 12, 14, in a convex manner, in the form of a pillow. In this way, the light exiting the light exit surfaces of the branches 12, 14 is bundled toward a secondary lens (see FIG. 9). Stray light beams having an undesirably large angle to the main beam direction, when exiting the light exit surfaces of the one branch (which would, for example, contribute to an undesirably bright grid structure on the driving surface) are preferably deflected past the secondary lens by the exit lens surfaces. This makes it possible to prevent an unintended, diffused illumination of dark regions in the emitted light distribution. An exit lens surface can be a border surface (for example, it can be a light exit surface of a branch) or it can be a light exit surface of a exit lens that is separate from the allocated branch. The branches and exit lenses are made of a transparent material, such as glass, PMMA, or PC. The optical fiber branches 12, 14 are distinguished, in particular, in that the transport surfaces exhibit surface norms having a directional component which faces more toward a first of the two narrow sides of the branch than toward a second of the two narrow sides of the branch, wherein this applies to a majority of all of the points of the transport surfaces onto which light, coupled by the associated light entry surface, falls. This will be explained in greater detail below, in reference to FIGS. 4A and 4B, which depicts, qualitatively, a section through the configuration 10 according to FIG. 3, running parallel to the light exit surfaces 12.2 and 14.2. In detail, FIGS. 4A and 4B shows a cross-section of the configuration 10, wherein this cross-section is composed of a cross-section through both the first branch 12 and the second branch 14.

Figure 2:
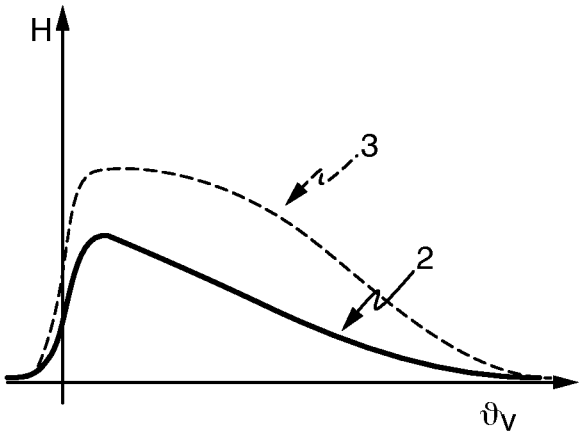
FIG. 2 shows a luminosity profile that can be obtained with a solution known in the art.
Figure 4A:
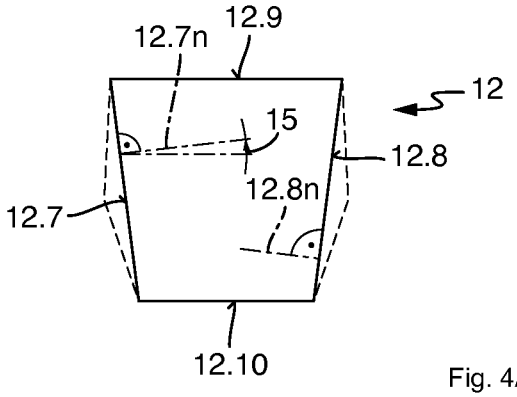
FIG. 4A shows a cut through the first optical fiber branch of FIG. 3.
Figure 4B:
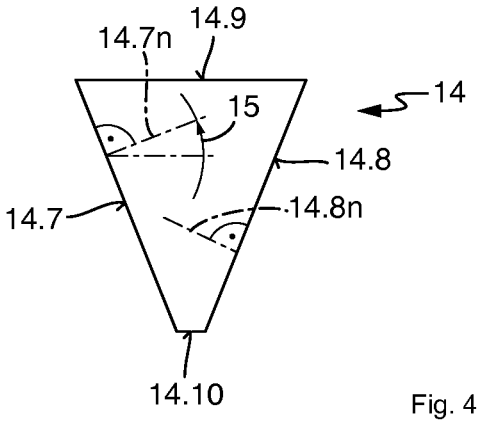
FIG. 4B shows a cut through the second optical fiber branch of FIG. 4.

The cross-section of the first branch 12 is shown in FIG. 4A and is bordered by a plurality of transport surfaces 12.7, 12.8, 12.9 and 12.10, which appear in FIGS. 4A and 4B as cut edges. The transport surface 12.7 is the transport surface bordered by the long side 12.6. The transport surface 12.8 is the transport surface bordered by the long side 12.6. The transport surface 12.9 is the transport surface bordered by the narrow side 12.3. The transport surface 12.10 is the transport surface bordered by the narrow side 12.4, The transport surfaces 12.7 and 12.9 bordered by the long sides 12.6 and 12.5 of the light exit surface of the second branch 12 exhibit surface norms. FIG. 2 shows a surface norm 12.7*n* for the transport surface 12.7 and a surface norm 12.9*n* for the transport surface 12.9. These two surface norms exhibit a directional component 15, which faces more toward a first narrow side 12.9 of the two narrow sides of the branch than toward a second narrow side 12.10 of the two narrow sides of the branch 12. This is shown in FIGS. 4A and 4B as the directional component 15 faces toward the transport surface 12.9, which is bordered by the narrow side 12.3. The narrow side 12.3 thus represents a first narrow side in one embodiment. Conversely, the directional component 15 faces away from the transport surface 12.10, which is bordered by the narrow side 12.4. The narrow side 12.4 thus represents a second narrow side in one embodiment.

The cross-section of the second branch 14 is shown in FIG. 4B and bordered by a plurality of transport surfaces 14.7, 14.8, 14.9, 14.10, which are shown in FIGS. 4A and 4B as cut edges. The transport surface 14.7 is the transport surface bordered by the long side 14.6. The transport surface 14.8 is the transport surface bordered by the long side 14.5. The transport surface 14.9 is the transport surface bordered by the narrow side 14.3. The transport surface 14.10 is the transport surface bordered by the narrow side 14.4. The transport surfaces 14.7 and 14.8, bordered by the long sides 14.6 and 14.5 of the light exit surface of the second branch 12 [sic], exhibit surface norms. FIG. 2 shows a surface norm 14.7*n* for the transport surface 14.7, and a surface norm 14.8*n* for the transport surface 14.8. These two surface norms likewise exhibit a directional component 15, which faces more toward a first of the two narrow sides of the branch 14 than toward a second of the two narrow sides of the branch 14. This is shown in FIGS. 4A and 4B in that the directional component 15 faces toward the transport surface 14.10 which is bordered by the narrow side 14.3. The narrow side 14.3 thus represents a first narrow side in one embodiment. Conversely, the directional component faces away from the transport surface 14.10, which is bordered by the narrow side 14.4. The narrow side 14.4 thus represents a second narrow side in one embodiment. The branches 12, 14 and their respective transport surfaces are designed such that the interrelations depicted in reference to FIGS. 4A and B apply for a majority of all of the points on the transport surfaces, onto which light, coupled by the associated light entry surface, falls.

With the depicted configuration 10, the narrow sides 12.4 and 14.3, lying directly adjacent and parallel to one another are a second narrow side 12.4 of the first branch 12, and a first narrow side 14.3 of the second branch 14. That the surface norm 14.7 has a directional component 15, which faces more toward a first narrow side 14.9 of the two narrow sides of the branch 14 than toward a second narrow side 14.10 of the narrow sides of the branch 14, should apply at least for the majority, but preferably all, of the points on the specified lateral transport surfaces of the second branch 14. That the surface norms 12.7, 12.9 of the first branch likewise exhibit a directional component, which faces more toward a first narrow side 12.9 of the two narrow sides of the branch 12 than toward a second narrow side 12.10 of the narrow sides of the branch 12, should also apply, in the case of the branch 12, at least for the majority, but preferably all, of the points on the specified transport surfaces of the first branch 12.

A substantial difference between the cross-sections through the first upper branch 12 and the second lower branch 14, exists because of the fact that the difference in widths of the narrow sides, in the case where the second branch 14 is greater than in the case of the first branch 12. A further difference is that the spacing of the narrow sides of a branch to one another is smaller in the case of the first branch 12 than in the case of the second branch 14. This preferably applies for all pairs of cross-sections cut through the branches 12, 14, in which the cross-sections of a pair exhibit the same spacing to their light entry surfaces and/or light exit surfaces. Both differences contribute thereto, in that the surface norms of the second branch 14 are directed more steeply toward the wider narrow side 14.9 of the second branch 14 than the surface norms of the first branch 12 are directed toward the wider narrow side of the first branch 12. As a result, the light propagated in the second branch 14 is concentrated comparably more strongly in the proximity of the wider narrow side of the second branch. The light propagated in the first branch 12, conversely, is concentrated comparably less strongly in the proximity of the wider narrow side of the first branch 12.

In one embodiment, the transport surfaces 12.7, 12.8, 14.7, 14.8 are bordered by straight lines. The border lines are curved in other designs, such that the shape of the transport surfaces is not bordered by flat surfaces. The surfaces can also be bowed in a convex or a concave manner. It is important, however, that the conditions specified for the surface norms be maintained. The upper and lower transport surfaces 12.9, 12.10, 14.9, 14.10 as shown in FIGS. 4A and 4B are preferably flat surfaces, which, in a top view, exhibit a trapezoidal form, in which the wider side lies on the light exit side of the respective branch. As a result, a concentration of the light onto the stripe width is also obtained. As an alternative to a trapezoidal shape, bordered by straight edges, the long sides can also be bowed in a concave or convex manner, wherein, however, the width of the surface becomes continuously greater as the spacing to the light entry surface increases and the spacing to the light exit surface decreases. This applies analogously to all cross-sections cut through the configuration in FIG. 3 lying parallel to the cross-section shown in FIGS. 4A and B.

As a result, the second branch 14 generates its own stripe-shaped light distribution, wherein the luminosity between the narrow sides of the light distribution changes comparably more strongly than is the case with the first branch. The first branch, conversely, generates its own light distribution, in which the luminosity between the narrow sides of the light distribution changes comparably less strongly than is the case with the second branch. Another difference is that the length of the light stripe generated by the second branch is greater than the length of the light stripe generated by the first branch. Due to the structural difference between the two branches 12, 14, they generate different light distributions on their light exit surfaces.

A luminosity maximum is obtained in the proximity of the first narrow side on the light exit surface of the first branch. As the spacing to the first narrow side of the light exit surface of the first branch increases, and the spacing to the second narrow side of the light exit surface of the first branch decreases, the luminosity decreases to a value, which preferably corresponds to the value which is obtained at the light exit surface of the second branch in the proximity of its first narrow side 14.3. As the spacing to the first narrow side 14.3 of the light exit surface of the second branch, and the spacing to the second narrow side of the light exit surface of the second branch increases, the luminosity decreases, gradually, and disproportionately quickly, as the spacing to the first narrow side increases, to a very low value, such that a softer luminosity diffusion is obtained.

Figures 5A, 5B, 5C:
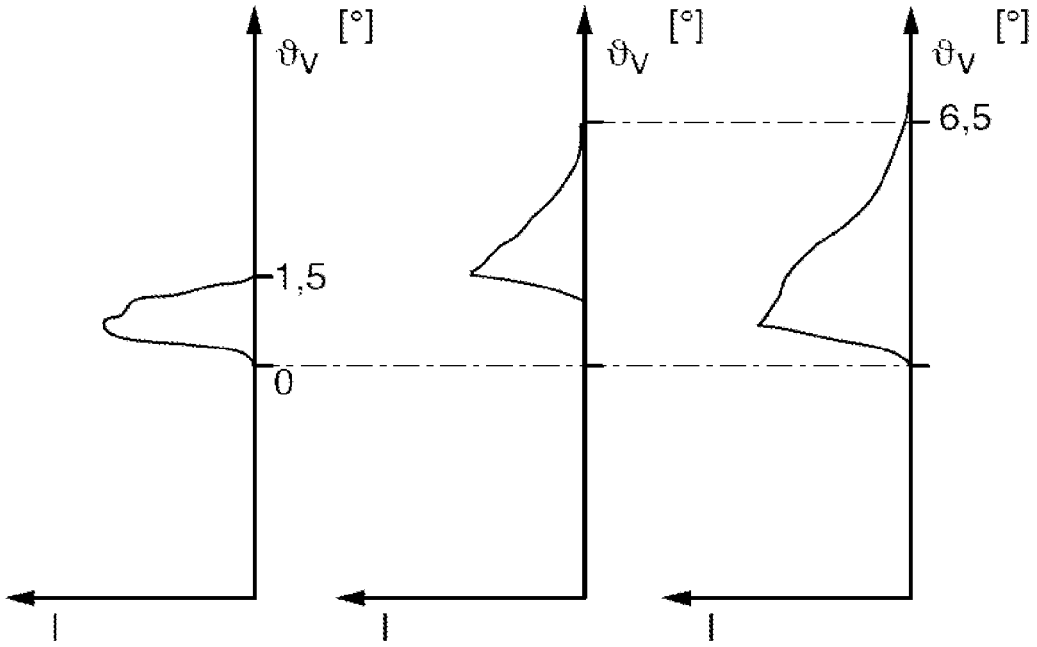
FIG. 5A shows the vertical profile of the luminosity I from the light distribution generated by the first branch of FIG. 3.
FIG. 5B shows the vertical profile of the luminosity I from the light distribution generated from the second branch of FIG. 4.
FIG. 5C shows the light distribution composed of the light distributions of FIGS. 5A and 5B.

FIG. 5A shows a vertical profile of the luminosity (or light intensity I) of the light distribution generated by the first branch, FIG. 5B shows the light distribution generated by the second branch, and FIG. 5C shows the light distribution composed of these two light distributions, over the angle ΘV. FIG. 5A shows the light distribution generated by the first branch 12, FIG. 5B shows the light distribution generated by the second branch 14, and FIG. 5C shows the overall light distribution obtained as the sum of the individual light distributions.

As shown in FIGS. 5A-5C, the first branch 12 has a pronounced maximum (at the level of value I) for the luminosity generated over a comparably narrow range of approximately 1.5° laterally. The strong increase in luminosity, starting from degree zero, corresponds to a sharp light/dark border. This is allocated to the narrow side 12.3. This sharp light/dark border is also obtained in the total light distribution of FIG. 5C. A likewise sharp light/dark border is also generated by the first branch at a side allocated to the second narrow side 12.4. In the total light distribution shown in FIG. 5C, this light/dark border is not depicted, however, because the decrease in luminosity in the light distribution generated by the first branch 12 is compensated for there by the increase in luminosity of the light distribution of FIG. 3*c*, generated by the second branch 14. The light distribution generated by the second optical fiber 14 is approximately 5 degrees in width in FIG. 3, and its luminosity decreases continuously (starting from is maximum luminosity) as the angular values increase, and at approximately 6.5 degrees, reaches a diminishing low value. The given angular values are not randomly selected values, but rather, are derived from the desired values for the stripe widths, the stripe heights, and the luminous fluxes, of the LEDs known in the art.

Thus, the second optical fiber 14 generates an expanded luminosity diffusion (for example, a continuous decrease in luminosity) which is not perceived as a sharp light/dark border, toward a narrow side of the light exit surface of the optical fiber 14. In FIG. 5C, the value ΘV=6.5° is assigned to this narrow side. At the same time, the second optical fiber 14 generates a comparably sharply bordered luminosity maximum at the other narrow side of its light exit surface. In FIG. 5A, the value ΘV=1.5° is assigned to this narrow side. An even higher maximum abuts this luminosity maximum, which is generated by the first optical fiber 12. The position of the bright stripe over the horizon depicted here is characteristic for a light module that generates a high beam portion of a light distribution for a motor vehicle headlamp. It is to be understood, however, that the invention is also suitable for generating a low beam light distribution. This is already derived from the ability to generate a sharp light/dark border on the one side of the luminosity maximum.

A low beam headlamp can be constructed with the same principles. For this, the stripes must diffuse toward the top (not toward the bottom). This configuration is obtained in that the secondary lens projects the configuration in an inverted and laterally reversed manner in the field in front thereof (for example, onto a measurement screen, or the driving surface). A bi-functional headlamp, which implements both high beam functions as well as low beam functions, can likewise be constructed with the principles presented herein. The branches 12 and 14 are, in fact, constructed with the same principles, as can be derived from FIGS. 4A and 4B and the associated description. However, they exhibit differences that result in different effects: at least one of the branches (in this case branch 12) is responsible for the maximum generation, and at least one other branch (in this case branch 14) is responsible for the diffused generation. Collectively, these generate a composite stripe having a high maximum and a pronounced luminosity diffusion, approaching an exponential course.

The transition from the edge of the concentration profile (which is generated by the first branch 12) toward the maximum of the diffusion profile (which is generated by the second branch 14) should occur in a seamless and imperceptible manner. In order to design the transition from the concentration profile to the diffusion profile such that it is imperceptible to the greatest possible extent, it is preferred that a single main exit lens surface is allocated to each of the adjacent light exit surfaces (which is disposed in the beam path) in each case, behind the light exit surface. The main exit lens surface of the one optical fiber then forms, respectively, a secondary exit lens surface for the adjacent optical fiber. Light that exits from an edge region of a main exit surface, and enters a secondary exit surface, due to its propagation direction, is deflected there, preferably such that it does not reach the secondary lens, and thus does not contribute to a distracting strong brightening of the transition region between the two individual light distributions. In this way, it is possible to join the individual light distributions (which are generated by the individual branches) to form a stripe-shaped light distribution (which corresponds to the desired profile), both with respect to the shape of the profile as well as with respect to the desired maximal value.

With regard to the circuitry for controlling the light sources, it is preferred that the control circuitry is configured for operating the light sources of a stripe collectively. Another design provides for an individual control of these light sources, such that an additional variability of the light distribution that is to be generated is obtained. In this way, for example, the light source generating the luminosity maximum can be dimmed, in order to accentuate the edge illumination, or the light source generating the edge illumination can be dimmed in order to more strongly direct the attention of the driver to the region illuminated with the maximum luminosity. It is also possible to dim individual stripes, in order to prevent a blinding of oncoming traffic, which is currently located within the relevant stripes contained in the light beam. The invention allows, in particular, for a profile scaling with a doubling of the luminous flux of the LED (for example, from 80 Lm to 160 Lm for each pair of branches), in which all luminosity values of the profile are likewise doubled.

Figure 6:
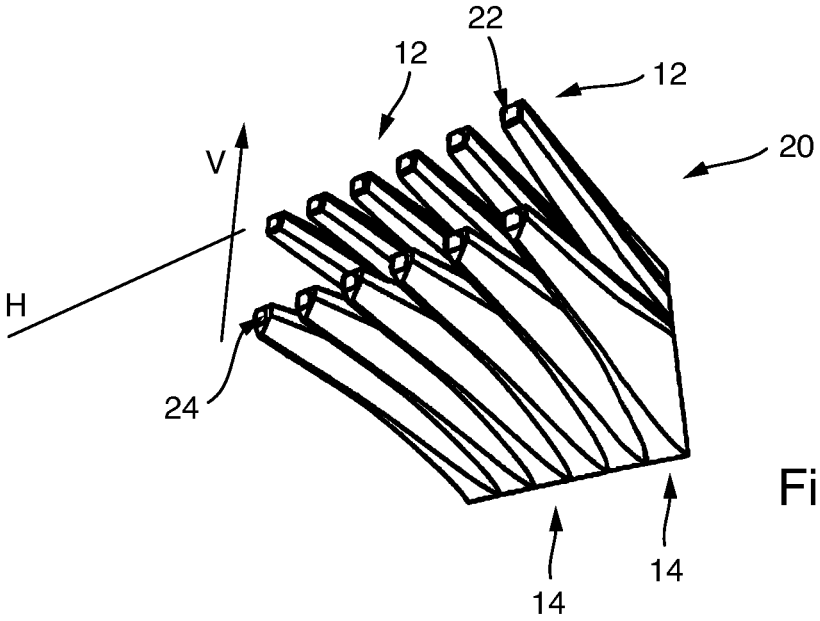
FIG. 6 shows one embodiment of a primary lens having numerous configurations of pairs of branches in a perspective view from a first perspective.

FIG. 6 shows an embodiment example of a primary lens 20 having numerous configurations of pairs of branches in a perspective view, in which, in particular, the light entry surfaces 22, 24 are visible. With a designated use in a light module of a motor vehicle, the pairs are disposed adjacent to one another in the horizontal direction H, and the branches of a pair are disposed above one another in the vertical direction V. The upper row is formed by the first branches 12. The lower row is formed by the second branches 14. Each first branch 12 and second branch 14 form, collectively, a configuration as shown in FIG. 3, which collectively generates one stripe of a light distribution. The six pairs lying adjacent to one another here are disposed laterally (along the horizontal axis H) at such a spacing to one another that the stripe-shaped light distributions generated by the pairs directly adjacent to one another directly abut, or transition into, one another at the borders. The light exit surfaces of the individual branches and/or the primary lens surfaces allocated thereto are preferably disposed such that they abut one another for this. It is particularly preferred that this is obtained by a single-piece, integrally joined implementation of the entire configuration includes, in this case, 6 pairs, each containing two branches. It is to be understood that the number of pairs can also differ from 6.

It is particularly preferred that the convex exit lenses are also integrated in this configuration. As a result, no adjustment steps are then necessary in order to configure the convex light exit surfaces in terms of their position in front of the light exit surfaces of the branch, and no attachment is necessary either, so as to firmly attach the configuration in the correct position. This applies analogously for the branches themselves as well, which, in a single-piece implementation, are firmly retained in a configuration to one another at the correct position, in the single-piece configuration.

In the design depicted in FIG. 6, the first branches 12 have a polygonal (for example, 8-sided) light entry surface 22, which is slightly larger than the active light emitting LED surface, and which is not rectangular. The first branch 12 preferably has a cross-section in which, when one regards the reference symbols in FIG. 4, an upper side 12.9 of a first pair 12 has basically the same width as is also the case at the halfway point of the spacing of the upper side 12.9 to the lower side 12.10, in the middle of the cross-section profile. In contrast to this, the lower side 12.10 is preferably somewhat narrower, such that the lower halves of the lateral surfaces provided with the reference symbols 12.7 and 12.8 form an inverted trapezoid. This is depicted in FIGS. 4A and 4B by a dotted line. This trapezoidal shape promotes the formation of a concentration that is closer to the upper decoupling edge. Because the inverted trapezoid is not as pronounced in the first branches as in the second branches 14, where this shape is clearly recognizable in FIG. 6, a strong diminishing of the luminosity diffusion is not formed in the upper branches 12.

The light exit surface of one of each of the pairs 12 and 14 is larger than the light entry surface 22 of the respective branch. This is an important prerequisite so that the branch can exert a bundling effect on the coupled luminous flux. In combination with the focal length of the mapping secondary lens that is used, this cross-section (pixel) is projected onto the driving surface. The angular height of this projection on a measurement wall standing perpendicular thereto, for the first branch 12, is 0.9°-1.5°, preferably approximately 1°.

As depicted by the second branches in FIG. 6, the light entry surfaces 24 have a different shape than those of the first branch 12. The light entry surfaces of the second branches 14 are polygonal. The second branches can have the same number of sides as the first branches 12. It is important, however, that the second branches extend over a larger angular range in the vertical direction than the first branches 12. This applies at least in the proximity of the light exit surfaces of the branch, but preferably for the entire length of the branch. The second branch 14, shaped in this manner as an inverted trapezoid, is more acute at the bottom (see also FIG. 4B). From the perspective of the LED, after the coupling, a larger portion of the coupled luminous flux reaches these angled lateral surfaces (which, in FIG. 4B, are associated with the edges 14.7 and 14.8). This portion of the luminous flux is deflected toward the wider of the narrow sides of the branch. The wider narrow side is preferably realized as a flat surface. As a result of the deflection, the luminosity maximum is obtained at the upper narrow decoupling edge, thus the wider narrow side of the light exit surface of the branch (and a diffusion of the luminosity resembling an exponential diffusion toward the narrower narrow side of the branch 14), is obtained.

The vertical expansion of the light exit surfaces of the second branches 14 is significantly larger here than the vertical expansion of the light exit surfaces of the first branches 12. The horizontal width of the light exit surfaces, in contrast, is preferably constant within a pair of branches. With the first branches 12 as well, the horizontal width of the respective light exit surface is wider than the horizontal width of the associated light entry surface of the branch. This results, particularly in the vertical direction, in a much stronger bundling occurring than in the horizontal direction. The angular height mapped by the secondary lens in a projection system for the stripes generated by a second branch 14 is 4°-6°, and preferably 5°. The collective stripe height is, for example, 1°+5.0°=6° in the vertical direction. This stripe height and the required luminosity value could not be obtained with only one branch and a single (conventional, and thus available for headlamps) LED supplying light to the branch, because the luminous flux of a single light source (LED) would not be sufficient. Only a doubling of the luminous flux for each LED could rectify this. This, however, is not physically possible. If one were to expand the coupling, such that a second LED could be applied to the same optical fiber, the required concentration would still be impossible to obtain, because the sources define an aperture angle with respect to the decoupling surface that is at least twice as large. Only separate optical fibers 12, 14, as proposed here, in a specific configuration, allow for a scaling of the luminosity profile as a function of the luminous flux. The luminosity maximum at the upper edge of the second optical fiber 14 is adjusted to the luminosity value of the lower edge of the associated first branch 12.

The illumination of a single stripe with two LEDs is accompanied by the fact that, in comparison with an illumination using only one LED, the doubled thermal power released in the chip of the LED(s) must be discharged. For this, it is known (and provided for here) that a heat sink be used. In conjunction with the present use of two branches for each stripe, further advantages are obtained.

With respect to an alternative design, in which the light from two LEDs is coupled in the same branch, with the use of two branches for each stripe (as proposed here), a larger spacing between the LEDs is obtained due to the light entry surfaces of the branches in a pair then exhibiting a spacing from one another. This simplifies the layout (wiring, etc.) of the circuit boards serving as the electrical connection for the LEDs and reduces the local thermal load. This allows for a use of standard circuit boards, which has a favorable effect on the production costs. When optical fibers of different heights are combined, the primary lens 26 for a striped headlamp can be generated. This can have the appearance depicted in FIGS. 7 and 8. For this, the primary lens is understood to be the entirety of the branches and their associated exit lenses, independently of whether these elements form a single-piece, integrally joined, cohesive structural unit, or are composed of individual components.

Figure 7:
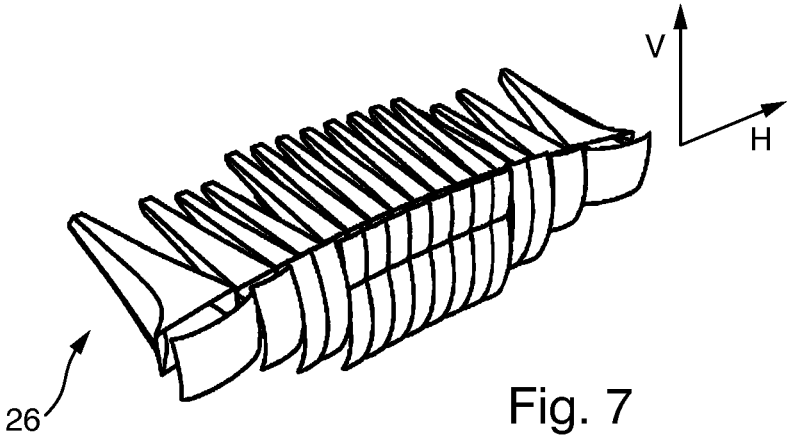
FIG. 7 shows a front view of a striped-high beam module, thus, in particular, a view of the light exit surface.

FIG. 7 shows a front view of a primary lens 26 for a striped high beam module (thus, a view of the light exit surface). Higher maximal values are required at the horizontal center of the striped headlamp than in the boundary stripes. Furthermore, higher stripes are also required for the central region (for example, ranging from −0.57° V to +6° V). For a stripe expanded in this manner, the luminous flux of a single light source would be insufficient. The energy profile must include at least two light sources, wherein the one forms a vertically narrow maximum range, and the second forms the diffusion. In the depicted design, the primary lens 8 has centrally disposed pairs of two branches lying vertically above one another. In this way, a high maximal luminosity, and a softer luminosity diffusion in the vertical direction, is obtained.

In contrast to this, softer diffusion in the horizontal direction is desirable in the boundary regions lying in the horizontal direction H to the left and right of the center, and the necessary maximal luminosities are not as high as those required in the center. For this reason, instead of pairs, only individual branches are disposed to the right and left of the center. It is particularly preferred thereby that numerous individual branches are used on each side, and that the horizontal width of the individual branches lying further from the center is greater than the horizontal width of the individual branches lying closer to the center. It is also preferred that the vertical height of the individual branches lying further from the center is less than the vertical height of the individual branches lying closer to the center. Each of these properties, considered alone and in combination with the respective other properties, contributes to a horizontally wide light distribution, having a soft diffusion toward the side.

Figure 8:
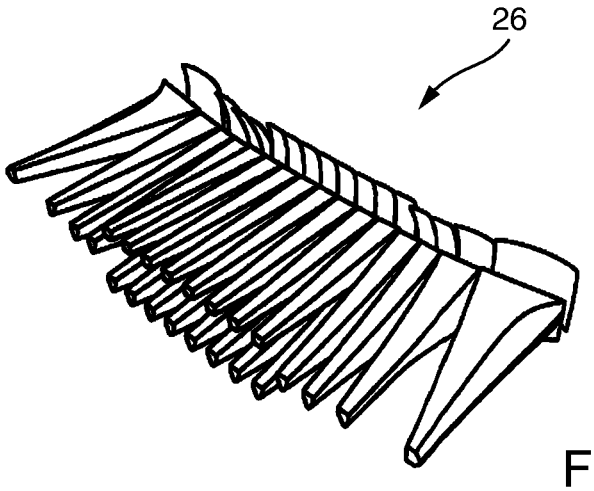
FIG. 8 shows a back view of a striped-high beam module, thus, in particular, a view of the light entry surface.

FIG. 8 shows, in contrast, a rear view of a primary lens 26 of this type, for a striped high beam module (thus, a view of the light entry surfaces). The combination of FIGS. 7 and 8 shows that each branch is allocated one associated exit lens.

Figure 9:
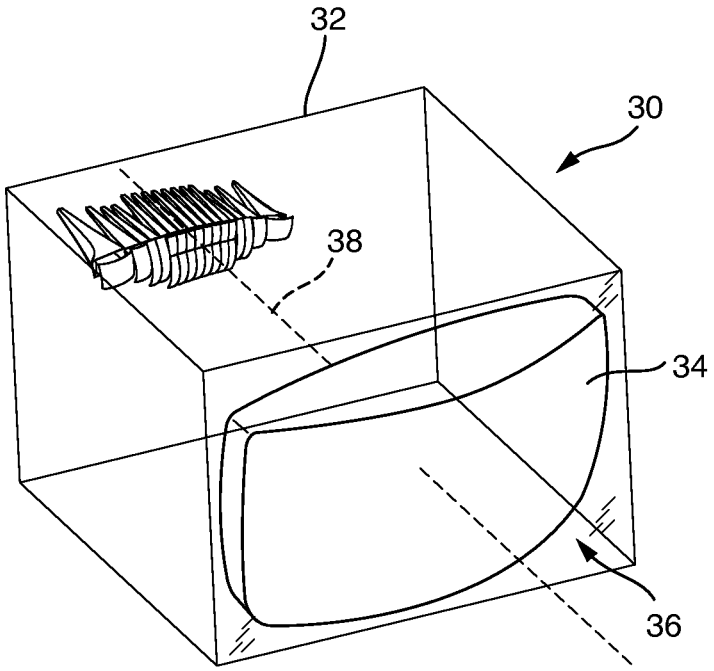
FIG. 9 shows schematically, a motor vehicle headlamp, having a design for a light module of the invention.

FIG. 9 shows, schematically, a motor vehicle headlamp 30 having a housing 32, which is covered by a transparent cover plate 34, and in which an embodiment example of a light module of the invention is disposed. The light module concerns a projection module. This exhibits, in particular, a primary lens 28. The primary lens corresponds to the subject matter of FIGS. 7 and 8. The light exit surfaces of the exit lens of this primary lens lie at a spacing of a focal length for a secondary lens 36 in the direction of the optical axis of the secondary lens in the light path in front of the secondary lens. The secondary lens is preferably made of a transparent material (in particular, glass or plastic such as PC or PMMA). In another design, the secondary lens is produced as a double-layered achromatic lens, made of both plastics. The secondary lens maps the internal light distribution, created on the entire light exit surface of the exit lens, in the form of an external light distribution in front of the headlamp. As components of the projection module, the primary lens and the secondary lens are disposed in relation to one another such that the primary lens concentrates the light bundle emitted from its exit lens onto the secondary lens such that as little light as possible passes beside the secondary lens. The light is emitted by LEDs, wherein preferably one LED is disposed in front of each light entry surface of one of the branches. In order to prevent chromatic aberrations, a secondary lens exhibiting achromatic lens properties is used on the lens surface of which scattering microstructures are disposed, distributed in a uniform or erratic manner.

The invention has been described in an illustrative manner. It is to be understood that the terminology which has been used is intended to be in the nature of words of description rather than of limitation. Many modifications and variations of the invention are possible in light of the above teachings. Therefore, within the scope of the appended claims, the invention may be practiced other than as specifically described.

What is claimed is:

1. A light module for a motor vehicle headlamp (30) having an optical fiber configuration (10) with at least one first optical fiber branch (12) and one second optical fiber branch (14), wherein each of the two branches exhibits a light entry surface (12.1, 14.1) and a light exit surface (12.2, 14.2), wherein the light exit surfaces are each bordered by two narrow sides (12.3, 12.4, 14.3, 14.4) and two long sides (12.5, 12.6, 14.5, 14.6), and wherein the two branches are disposed such that a narrow side (12.4) of the first branch is disposed parallel and directly adjacent to a narrow side (14.3) of the light exit surface of the second branch, wherein the narrow sides of the light exit surfaces of the two branches are of the same length, while the long sides of the light exit surface of the second branch are longer than the long sides of the light exit surface of the second branch, and wherein each branch has two transport surfaces (12.7, 12.8, 14.7, 14.8), which border an optical fiber volume extending between the light entry surface and the light exit surface of each branch, and on which, the light propagated in the optical fiber is subjected to a total internal reflection, and is bordered by the long sides of the light exit surface of the branch, wherein the transport surfaces exhibit surface norms (12.7*n*, 12.8*n*, 14.7*n*, 14.8*n*), which exhibit a directional component, which faces more toward a first narrow side (12.3, 14.3) of the two narrow sides of the branch than toward a second narrow side (12.4, 14.4) of the two narrow sides of the branch, wherein this applies to a majority of all of the points on the transport surfaces onto which the light, coupled via the associated light entry surface, falls, and in that the narrow sides lying directly adjacent and parallel to one another are a second narrow side (12.4) of the first branch and a first narrow side (14.3) of the second branch.

2. The light module as set forth in claim 1, wherein a difference in the widths of the narrow sides in the case of the second branch (14) is greater than in the case of the first branch (12).

3. The light module as set forth in claim 2, wherein for all pairs of cross-sections through the branches 12, 14, the cross-sections of a pair exhibit the same spacing to their light entry surfaces and/or light exit surfaces.

4. The light module as set forth in claim 1, wherein a spacing of the narrow sides of a branch to one another is smaller in the case of the first branch (12) than in the case of the second branch (14).

5. The light module as set forth in claim 1, wherein the second branch (14) is configured to generate on its own a stripe-shaped light distribution, in which the luminosity changes comparably more strongly between the narrow sides of the light distribution than is the case with the first branch.

6. The light module as set forth in claim 5, wherein the stripe-shaped light distribution generated by the second optical fiber (14) is 4° -6° laterally in the longitudinal direction of the stripe, and continuously diminishes, starting from its luminosity maximum as it approaches higher angular values.

7. The light module as set forth in claim 1, wherein the first branch is configured to generate on its own a stripe-shaped light distribution, in which the luminosity changes comparably less strongly between the narrow sides of the light distribution than is the case with the second branch.

8. The light module as set forth in claim 1, wherein the first branch (12) is configured to generate a pronounced maximum of the luminosity in the longitudinal direction of the stripe over a comparably narrow range of approximately 0.9° -1.5° laterally, in particular over a range of approximately 1° laterally.

9. The light module as set forth in claim 1, wherein the light exit surface (12.2) of the first branch is allocated to an exit lens surface (12.*a*), disposed downstream in the beam path, and in that the light exit surface (14.2) of the second branch is allocated to an exit lens surface (14.*a*) disposed downstream in the beam path, wherein these exit lens surfaces are, in each case, bowed away from the branches (12, 14) in a convex manner, in the shape of a pillow.

10. The light module as set forth in claim 9, wherein each of the exit lens surfaces is a light exit surface of a branch, or in that it is a light exit surface of an exit lens, separate from the associated branch.

* * * * *